United States Patent [19]

McDowell

[11] 4,207,495

[45] Jun. 10, 1980

[54] MEANS FOR IMPROVING THE COLLECTOR EFFICIENCY OF AN EMITTING SOLE CROSSED FIELD AMPLIFIER

[75] Inventor: Hunter L. McDowell, Concord, Mass.

[73] Assignee: The United States of America as represented by the Secretary of the Air Force, Washington, D.C.

[21] Appl. No.: 938,128

[22] Filed: Aug. 30, 1978

[51] Int. Cl.[2] ..... H01J 25/34

[52] U.S. Cl. ..... 315/39.3; 313/103; 315/5.38; 330/43

[58] Field of Search ..... 315/39.3, 3.5, 5.38; 313/103; 330/43

[56] References Cited

U.S. PATENT DOCUMENTS

| | | | |
|---|---|---|---|
| 2,807,744 | 9/1957 | Lerbs | 315/3.6 |
| 2,890,372 | 6/1959 | Dench | 315/39.3 X |
| 3,046,443 | 7/1962 | Dench | 315/3.5 X |
| 3,069,587 | 12/1962 | Dench | 315/39.3 X |
| 3,069,594 | 12/1962 | Feinstein | 315/39.3 |
| 3,084,279 | 4/1963 | Osepchuk | 315/39.3 |
| 3,197,672 | 7/1965 | Favre | 315/39.3 |
| 3,273,006 | 9/1966 | Osepchuk | 315/39.3 X |
| 3,384,782 | 5/1968 | Reddish | 315/39.3 |

*Primary Examiner*—Saxfield Chatmon, Jr.

*Attorney, Agent, or Firm*—Joseph E. Rusz; Willard R. Matthews, Jr.

[57] ABSTRACT

Crossed field amplifier collector efficiency is improved by decreasing the ratio of electron velocities to r.f. signal wave velocity at the output end of the amplifier slow wave circuit. In a preferred embodiment of the invention this is accomplished by tapering the sole emitting cathode so as to increase the cathode-slow wave circuit spacing in the output end of the interaction region prior to the collector. Alternatively, an increasing r.f. signal phase velocity taper can be used to provide the required decreased electron velocities to r.f. signal wave velocity ratio.

4 Claims, 4 Drawing Figures

FIG. 1
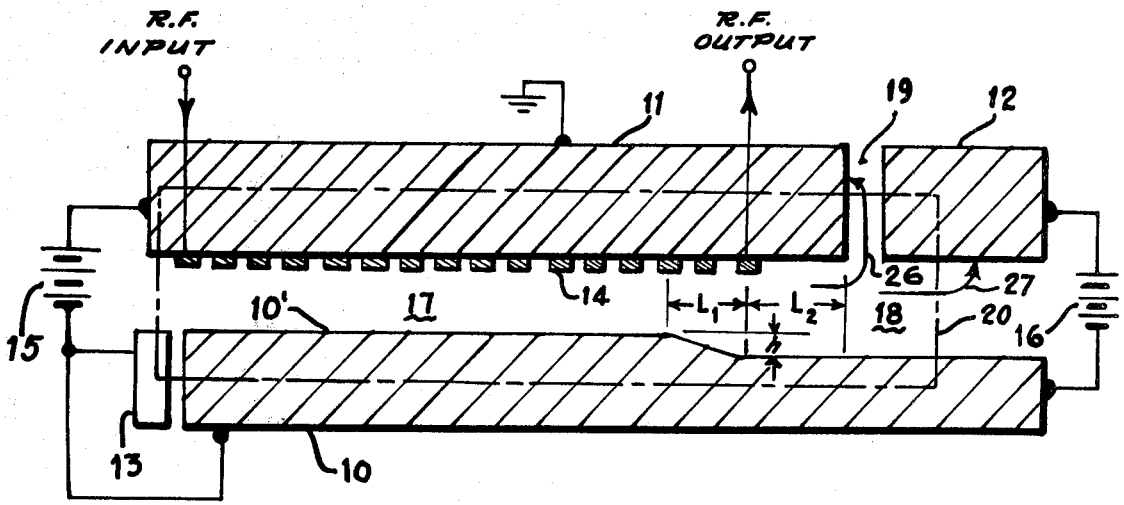
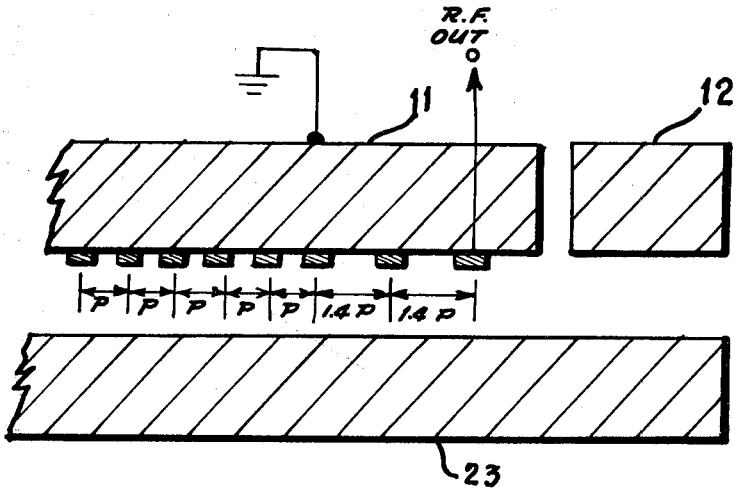
FIG. 4

MEANS FOR IMPROVING THE COLLECTOR EFFICIENCY OF AN EMITTING SOLE CROSSED FIELD AMPLIFIER

STATEMENT OF GOVERNMENT INTEREST

The invention described herein may be manufactured and used by or for the Government for governmental purposes without the payment of any royalty thereon.

BACKGROUND OF THE INVENTION

This invention relates to traveling wave tubes and in particular to emitting sole crossed field amplifiers and means for improving the collector efficiency of such devices.

The improvement of collector efficiency in traveling wave tubes has been a continuing design objective that has never been fully realized by prior art techniques. These collector efficiency problems and typical prior art approaches to solving them are described in detail in U.S. Pat. No. 3,271,618 of G. P. Kooyers entitled *Depressed Collectors For Crossed Field Traveling Wave Tubes.* The usual approach in linear beam type devices is to use a depressed collector. The techniques applicable to linear beam type devices are not always useful when applied to crossed field type amplifiers, however. The Kooyers patent discloses a means for improving collector efficiency in crossed field type devices that utilizes a split collector each segment of which is operated at a different depressed voltage. The split elements of the collector are also tapered. The present invention comprehends utilizing a depressed collector and tapering the final stage of the crossed field amplifier interaction region as a means for improving collector efficiency. Tapering can be accomplished physically by tapering the sole emitting cathode structure or electrically by increased tapering of the r.f. slow wave circuit or by shaping the magnetic field. Although the final stages of some linear beam tube slow wave structures have been tapered to keep the electron beam in synchronism with the traveling wave the approach has not been used in crossed field devices which have relatively constant drift velocities. The U.S. Pat. No. 4,087,718 of George F. Farney entitled *High Gain Crossed Field Amplifier* discloses a crossed field device having a tapered slow wave structure. The taper is, however, for the purpose of increasing device amplification and is a decreasing taper.

SUMMARY OF THE INVENTION

The invention is an emitting sole crossed field amplifier in which the output end of the interaction region is configured, either geometrically or electrically to utilize the device's characterisitic hub and spoke charge distribution in a way that significantly improves collector efficiency. This is accomplished by configuring the region immediately prior to the ouput end of the slow wave circuit in such a way as to effect a decrease in the ratio of electron velocities to r.f. signal wave velocity. As a consequence charge is drained from the spokes and reduced d.c. fields cause a reduction of charge in the hub. Concurrently, the velocity of the charge is reduced, substantially reducing the net current to the collector system. The remaining current lies largely at a potential below synchronous voltage of the crossed field amplifier and is effectively collected by a depressed collector.

It is a principal object of the invention to provide a new and improved emitting sole crossed field amplifier.

It is another object of the invention to provide an emitting sole crossed field amplifier having improved collectorefficiency.

It is another object of the invention to provide an emitting sole crossed field amplifier wherein the output end of the r.f. slow wave circuit is configured in a manner that takes advantage of the device's characteristic hub and spoke charge distribution to improve charge collection efficiency.

These together with other objects, features and advantages will become more readily apparent from the following detailed description when taken in conjunction with the illustrative embodiments in the accompanying drawings.

DESCRIPTION OF THE DRAWINGS

FIG. 1 is a sectional view of a crossed field amplifier incorporating one presently preferred embodiment of the invention;

FIG. 4 is a partial sectional view of a crossed field amplifier incorporating an alternative embodiment of the invention.

DETAILED DESCRIPTION OF THE PREFERRED EMBODIMENTS

Figure 2:
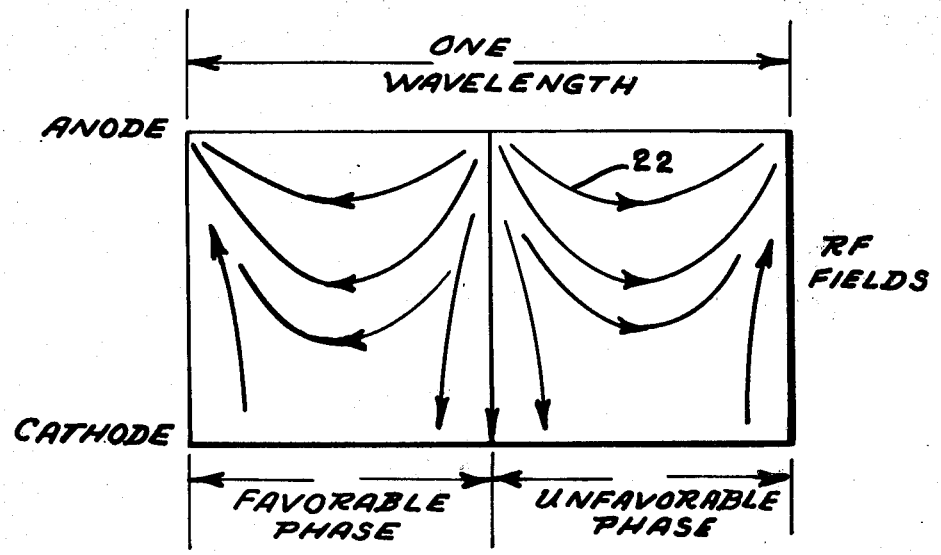
FIG. 2 is a schematic illustration of the force fields in the high power interaction region of the crossed field amplifier of FIG. 1.

The present invention comprehends a traveling wave tube having improved collector efficiency. The particular structure hereinafter described by way of example comprises a non-reentrant emitting sole crossed field amplifier. It is illustrated in generalized form by FIG. 1 in which only those elements necessary to the description of the invention are shown.

Referring now to FIG. 1 the device disclosed comprises emitting sole cathode means 10 having a main secondary emitting surface 10' (typically maintained at −9.5 Kv), thermionic primary source cathode 13, anode 11, r.f. slow wave circuit 14, interaction region 17, collector 12 (typically maintained at −7.5 kv) and power supplies 15 and 16. Slow wave circuit 14 is commonly a meander type line that is isolated from anode 11 by insulation means (not shown). A magnetic field normal to the plane of the drawing is established by a magnetic field means 20 (shown in phantom).

Figure 3:
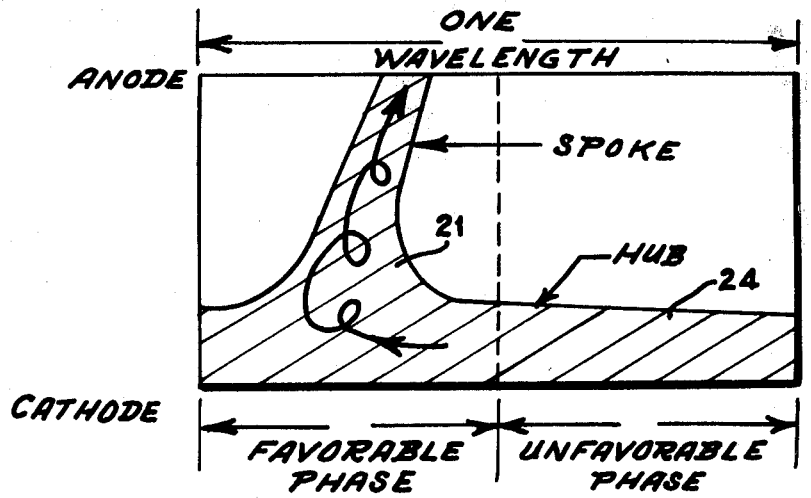
FIG. 3 illustrates the change distribution in the high power interaction region of the crossed field amplifier of FIG. 1.

Electron emission from emitting surface 10' is initiated from primary source cathode 13 and travels along interaction region 17 toward the output end of the device under the influence of the r.f. and magnetic fields. Force lines 22 of FIG. 2 illustrate the r.f. field in the high power region of the device. FIG. 2 illustrates one wavelength of the crossed field amplifier with the "favorable phase" being the half wavelength in which electrons give up energy to the r.f. wave traveling on slow wave circuit 14. The r.f. and magnetic fields cause the electrons to bunch up into a characteristic charge distribution configuration as shown by FIG. 3. This takes the form of a hub 24 and spoke 21. Such a charge distribution forms at each wavelength of the traveling r.f. wave.

At the end of the crossed field amplifier a substantial amount of charge is left in the interaction region. It has been discovered that by decreasing the ratio of cathode-to-Hartree voltage prior to the end of the r.f. circuit the flow of electrons from the hub into the spokes is inhibited. The Hartree voltage referred to is the value of cathode voltage required to make the top layer of the hub synchronous with the r.f. circuit wave. This, in effect, is equivalent to decreasing the ratio of electron velocities to r.f. signal wave velocity. As a result of this process the charge left in the spokes is drained off by the r.f. interaction. There is thus a minimum of partially interacted charge above the hub at the end of the crossed field amplifier.

In practice this effect can be implemented by increasing the anode-to-cathode spacing near the r.f. slow wave circuit output. The spacing increase is begun prior to the RF output. This causes the charge which enters the base of the spokes to decrease and charge is, therefore, drained from the spokes. At the same time the reduced d.c. fields causes a reduction in the charge in the hub so that at the end of the taper region the total charge in the system is reduced to about half that existing prior to the taper region. At the same time the velocity of the charge is reduced so that the net current which enters the collector system is substantially reduced. This remaining current lies largely at a potential below synchronous voltage of the crossed field amplifier and may be collected by a depressed collector. This minimizes the d.c. input to the crossed field amplifier.

As shown by arrows 26, 27 in FIG. 1, the trajectories branch in the collector system with those electrons at a potential above the depressed collector (arrow 26) being diverted into vertical channel 19 where they are collected at anode potential. Collection occurs because this channel spacing is not cut off. Channel spacing cut off is a function of the mangetic field and the channel dimensions. The channel is cut off if an electron released from the negative surface (emitting sole cathode 10) returns to that surface rather than being collected on the more positive surface (anode structure 11 or depressed collector 12). This occurs because the effect of the magnetic field causes the electrons to follow a cycloidal trajectory back to the cathode if the channel dimensions permit. That is, the electron flow from cathode to anode is "cut off". The decreasing magnetic field in the region beyond the edge of magnetic field means 20 in the vertical direction in FIG. 1 insures that the non-cut off condition will be met at some point in the vertical channel. The electrons below the depressed collector potential (arrow 27) in FIG. 1 proceed to the right. The magnetic field also decreases in this direction in the collector and eventually the main channel is no longer cut off. At this point, collection of the space charge on the depressed collector begins.

Referring again to FIG. 1 it is shown that anode to cathode spacing has been increased by tapering the cathode 13 at the output end of the device. The spacing increase typically can be 40% to 60%. The slope of the taper typically can be 10 to 1. The distance L2 must be adequate for most charges above the hub to reach the anode before the collector. Typically L2 will be two to four wavelengths of the r.f. slow wave on the anode.

The taper may be accomplished by tapering anode-cathode spacing as described above or, alternatively, by tapering circuit phase velocity or the magnetic field. FIG. 4 illustrates an embodiment utilizing tapered circuit phase velocity. In this arrangement the cathode 23 is at a constant spacing from the anode but the r.f. slow wave circuit spacing at the end of the interaction space is increased by a factor of 1.4. Magnetic field tapering also can be accomplished by configuring the magnetic field to increase prior to and then decrease after the r.f. output. This can be accomplished by any conventional means. Magnetic field and circuit phase velocity tapering can be used individually to accomplish the objects of the invention or they can be used in conjunction with the geometrically tapered embodiment.

While the invention has been described in its preferred embodiments it is understood that the words which have been used are words of description rather than words of limitation and that changes within the purview of the appended claims may be made without departing from the scope and spirit of the invention in its broader aspects.

What is claimed is:

1. An emitting sole crossed field amplifier comprising an anode structure, an anode slow wave circuit on said anode structure having an input receiving an r.f. signal, and an output, an emitting sole cathode having a main secondary emitting surface, said emitting sole cathode being in spaced adjacent relationship to said anode slow wave circuit and establishing an interaction region between its main secondary emitting surface and said slow wave circuit, said emitting sole cathode being configured to provide increased main secondary emitting surface to slow wave circuit spacing extending from a tapered transition section through the output end of said anode slow wave circuit, a depressed collector spaced from and adjacent said anode structure at the output end of said slow wave circuit and further being spaced from and adjacent said emitting sole cathode, said collector in part defining a channel between itself and said anode structure and also defining a channel between itself and said emitting sole cathode, a power supply connected to and effecting emission of electrons from said emitting sole cathode, and magnetic field means establishing a magnetic field in said interacting region and effecting electron flow there along, said magnetic field means further being configured to establish a cut off condition along a limited portion of the collector-anode channel and also establishing a cut off condition along a limited portion of the collector-sole emitting cathode channel.

2. An emitting sole crossed field amplifier as defined in claim 1 wherein said main secondary emitting surface to slow wave circuit spacing is increased by not less than 40% nor more than 60%.

3. An emitting sole crossed field amplifier as defined in claim 1 wherein said tapered transition section has a slope of approximately 10 to 1.

4. An emitting sole crossed field amplifier comprising an anode structure, an anode slow wave circuit on said anode structure having an input receiving an r.f. signal, and an output, said anode slow wave structure comprising a meander transmission line having increased spacing at its output end, an emitting sole cathode having a main secondary emitting surface, said emitting sole cathode being in spaced adjacent relationship to said anode slow wave circuit and establishing an interaction region between its main secondary emitting surface and said slow wave circuit, a depressed collector spaced from and adjacent said anode structure at the output end of said slow wave circuit and further being spaced from and adjacent said emitting sole cathode, said collector in part defining a channel between itself and said anode structure and also defining a channel between itself and said emitting sole cathode, a power supply connected to and effecting emission of electrons from said emitting sole cathode, and magnetic field means establishing a magnetic field in said interacting region and effecting electron flow there along, said magnetic field means further being configured to establish a cut off condition along a limited portion of the collector-anode channel and also establishing a cut off condition along a limited portion of the collector-sole emitting cathode channel.

* * * * *